US010502406B2

(12) United States Patent
He

(10) Patent No.: US 10,502,406 B2
(45) Date of Patent: Dec. 10, 2019

(54) LED FILAMENT LAMP USING INFRARED RADIATION HEAT DISSIPATION AND LED LIGHTING BAR THEREOF

(71) Applicant: SHENZHEN FENGGONG CULTURE COMMUNICATION CO., LTD., Shenzhen, Guangdong (CN)

(72) Inventor: Siding He, Guangdong (CN)

(73) Assignee: SHENZHEN FENGGONG CULTURE COMMUNICATION CO., LTD., Shenzhen (CN)

( * ) Notice: Subject to any disclaimer, the term of this patent is extended or adjusted under 35 U.S.C. 154(b) by 0 days.

(21) Appl. No.: 16/236,351

(22) Filed: Dec. 29, 2018

(65) Prior Publication Data

US 2019/0203921 A1 Jul. 4, 2019

(30) Foreign Application Priority Data

Dec. 29, 2017 (CN) ..... 2017 1 1476093

(51) Int. Cl.

| | |
|---|---|
| ***F21V 29/00*** | (2015.01) |
| ***F21V 29/503*** | (2015.01) |
| ***F21K 9/66*** | (2016.01) |
| ***F21K 9/238*** | (2016.01) |
| ***F21K 9/64*** | (2016.01) |
| ***F21K 9/232*** | (2016.01) |
| ***F21V 7/22*** | (2018.01) |
| ***F21V 23/00*** | (2015.01) |
| *F21Y 115/10* | (2016.01) |
| *F21Y 113/13* | (2016.01) |
| *F21Y 103/10* | (2016.01) |

(52) U.S. Cl.

CPC ..... *F21V 29/503* (2015.01); *F21K 9/232* (2016.08); *F21K 9/238* (2016.08); *F21K 9/64* (2016.08); *F21K 9/66* (2016.08); *F21V 7/22* (2013.01); *F21V 23/002* (2013.01); *F21Y 2103/10* (2016.08); *F21Y 2113/13* (2016.08); *F21Y 2115/10* (2016.08)

(58) Field of Classification Search

None

See application file for complete search history.

(56) References Cited

FOREIGN PATENT DOCUMENTS

WO 2012/031533 A1 3/2012

*Primary Examiner* — Vip Patel

(57) ABSTRACT

Disclosed is an LED filament lamp using infrared radiation heat dissipation and an LED lighting bar thereof. The LED filament lamp includes a bulb shell, a core base with an exhaust pipe, a driver, a lamp cap, and at least one LED lighting bar with 2π light-emitting LED chip. The bulb shell and the core base are in vacuum sealing to form a vacuum sealed cavity filled with high heat conductivity gas; the LED lighting bar is located in the vacuum sealed cavity; one side of which is provided with a light-emitting layer of the LED chip, and the other side is provided with an infrared radiation converting layer; both ends of the LED lighting bar are fixed to the core base through a metal wire and connected to the driver; and the driver and the lamp cap are connected in series through an outer electrode leading-out wire.

17 Claims, 14 Drawing Sheets

LED FILAMENT LAMP USING INFRARED RADIATION HEAT DISSIPATION AND LED LIGHTING BAR THEREOF

CROSS REFERENCE TO RELATED APPLICATIONS

The present application claims the benefit of Chinese Patent Application No. 201711476093.5 filed on Dec. 29, 2017. All the above are hereby incorporated by reference.

TECHNICAL FIELD

The present invention relates to the technical field of lighting, and more particularly relates to an LED lamp filament lamp using infrared radiation heat dissipation and an LED lighting bar thereof.

BACKGROUND ART

The emergence of tungsten incandescent lamp in the $19^{th}$ century led the world into the era of artificial illumination. Since the $20^{th}$ century, a revolutionary new light source, LED, has rapidly entered the lighting market due to its advantages of energy saving, environmental protection and long life. LED has become the leading lighting source in the future, and is widely used in commercial lighting, industrial lighting, outdoor lighting, and so on. However, in the past, LED light sources, such as plug-in LEDs, SMD LEDs, chip on board (COB), integrated high-power LED lamp beads, can only be plane light sources without optical devices such as lenses.

In 2008, Japanese Ushio Light Source introduced a bulb-type lamp using LED filaments configured with an incandescent lamp prototype. LED filament lamp truly realizes 360-degree full-angle light-emitting stereo light sources, which satisfies customers' full-view light-emitting requirements, brings unprecedented illumination and is more energy-saving. Since the Japanese Ushio light source was first introduced and mass-produced, candle lamps and bulb lamps with LED filaments as light sources have gradually been favored by more and more consumers in the market.

The existing LED filament lamp generally consists of a bulb shell, a plurality of LED filaments, a core column with a bracket, a driver, and a lamp cap. The LED filaments are arranged on the bracket of the core column to achieve 360-degree light emitting. The LED filament is generally formed by die bond of blue LED lamp beads without back plating on a substrate bar made of sapphire, transparent ceramic, fluorescent crystal, glass, or carved copper plate, and then the lamp beads are all connected in series by a gold wire, and the lighting bar is coated with a yellow phosphor so as to emit white light.

In order to realize 4π light emitting (i.e., 360-degree light emitting), the existing LED filaments mostly adopt a transparent substrate design, and the substrate is made of a transparent material such as sapphire, transparent ceramic or glass. For example, Taiwan Epistar, Zhejiang Ledison and other companies have obtained a large number of patents on transparent substrates. For example, the patent application No. WO/2012/031533 filed by Zhejiang Ledison Optoelectronic Co., Ltd. discloses an LED bulb and an LED lighting bar capable of 4π light emitting. The LED bulb includes: a LED light bulb shell; a core column with an exhaust tube and a bracket; at least one LED light emitting strip with LED chips emitting 4π light; a driver; and an electrical connector, wherein the LED light emitting strip comprises a transparent substrate and at least one series of LED chips on the transparent substrate and connected in series in such a manner that the PN junctions therein have a same direction, the LED chips having transparent chip substrates. 4π light emitting is realized by using the transparent substrate to increase the light-emitting rate.

In the patent application No. WO/2012/031533, the LED lighting bar with the 4π light-emitting LED chip is used to improve the light-emitting rate of the LED chip, so as to improve the luminous efficiency of the LED filament lamp, which is one of the research directions of the LED filament lamp. However, such LED filament lamps cannot solve another key problem of the LED filament lamp, i.e., heat dissipation. The heat of an LED lamp is mainly generated by an LED chip and a power device of a drive circuit. The LED lamps in the prior art generally use low-voltage and high-current power LEDs, one LED chip has one PN junction, and the operating current is as large as 0.35 A or even several ampere, the electric power of 1 W to several watt or more is concentrated on a chip of 1 to several square millimeters, the external quantum efficiency is only about 30%, with an energy difference between injected electrons and generated photons and an energy difference between photons generated by the PN junction and the last emitted photons, about 70% of the electric power will be converted into heat, and how to dissipate this large amount of heat has always been one of the key problems of LED filament lamps. LED is a semiconductor device, and the junction temperature of the PN junction rises, which will cause the luminous efficiency to drop rapidly, or even the PN junction to burn up. As the temperature rises, silica gel used to coat an LED chip will have a cracking problem, directly affecting the service life of the LED filament lamp.

For a single LED, when heat is concentrated in a chip of small size and cannot be effectively dissipated, the temperature of the chip increases, causing the non-uniform distribution of heat stress, and the reduction of the luminous efficiency of the chip and the lasing efficiency of a phosphor. Studies have shown that when the temperature exceeds a certain value, the failure rate of the device will rise exponentially, and the reliability of a component will decrease by 10% for every 2° C. rise. In order to ensure the life of the device, the PN junction temperature is generally required to be below 110° C. As the temperature of the PN junction rises, the light-emitting wavelength of a white LED device will be red-shifted. The statistical data show that at 100° C., the wavelength may be red-shifted by 4-9 nm, which leads to the increase of non-radiation of a YAG phosphor with the increase of temperature and the reduction of the conversion light energy, resulting in reduction of conversion efficiency, reduction of the total luminous intensity, and poor white light chroma. At around room temperature, for every 1° C. rise in temperature, the luminous intensity of LED will be reduced by about 1%.

In order to solve the heat dissipation problem, many LED bulb lamps in the prior art use metal heat sinks with heat sink fins, and there has been a lot of researches and patents on the material and shape of such heat sinks and how to increase the convective heat exchange with air. Such metal heat sinks are mainly made of aluminum alloy, which are heavy and costly, and have become one of the key factors for the high cost of the existing LED bulb lamps. In order to solve the problem of 4π light emitting, many LED filament substrates use sapphire or diamond, etc., but sapphire, diamond, etc. are very expensive, directly increasing the cost of the LED lamp.

In the above-mentioned patent application No. WO/2012/031533, it uses a gas convection heat dissipation structure to dissipate heat through the convection and heat conduction of gas in a bulb shell and then through a bulb. But in fact, such heat dissipation structure cannot effectively dissipate heat. First, it uses a transparent substrate, and the selected substrate material is made of glass, transparent ceramic or plastic, thus the heat conductivity coefficient is low. Heat generated by an LED chip needs to be conducted through a substrate to dissipate heat by gas convection. In this patent, the heat conductivity coefficient of the substrate is low, and under the action of heat insulation of phosphor glue, the heat generated by the LED chip cannot be effectively conducted by the transparent substrate and a phosphor glue layer, not to mention gas convection heat dissipation. Besides, the material of the bulb shell is also glass. In fact, by means of gas convection heat dissipation, it is also difficult to dissipate heat through the glass bulb shell, and heat dissipation through the glass bulb shell may also cause over-high temperature of the bulb shell, which brings a certain danger.

In order to solve the heat dissipation problem, heat dissipation by heat radiation is used. On Nov. 9, 2016, the applicant filed a patent application claiming for power-supply built-in LED filament lamp using heat-radiating material. By arranging a layer of heat-radiating material on the surface of the LED filament, heat is dissipated through heat radiation, but there was no systematical explanation of radiation heat dissipation, and there is room for improvement in the heat dissipation effect.

The radiation heat dissipation may be understood as the way in which an infrared ray is emitted from the surface of a higher-temperature object and is received by a lower-temperature object. As we all know, the space outside the atmosphere is close to absolute zero, and the temperature in the upper atmosphere is also quite low. This is also a natural huge cold storage. The huge capacity of the space makes it a "black hole" for heat. If we discharge the unwanted heat on the ground into the space in the form of electromagnetic waves, we can achieve the purpose of cooling. Radiation cooling is such a non-consumption mode of cooling.

The researchers analyze the spectral transmission characteristics of the Earth's atmosphere, and the transmission spectrum is shown in FIG. 1. It can be seen from FIG. 1 that the atmosphere has different transmittances for different wavelengths of radiation. In an interval where the transmittance is high, the electromagnetic waves in the wavelength band can penetrate through the atmosphere more freely, and these intervals are meteorologically referred to as the "window" of the atmosphere. The spectral transmission characteristics of the atmosphere are mainly determined by water vapor, carbon dioxide and ozone in the atmosphere. The change in their content causes a change in transmittance, but the distribution of the transmission spectrum does not change much. Among several atmospheric windows, the band of 8 to 13 μm is more notable because the wavelength of blackbody radiation at normal temperature is mainly concentrated in this band. The atmosphere is permeable to electromagnetic radiation in this band. So, if there is a material that converts heat into electromagnetic waves in this particular band, heat waste can leave the earth. As a heat-dissipating mode that does not consume energy, it will have broad application prospects in the field of LED filament lamps.

In addition to the heat dissipation problem, preventing blue light leakage is also one of the key problems in the LED industry. In recent years, a lighting technology has improved in terms of light output and lifetime, but in order to improve brightness, each novel light source has greatly increased the content of blue light, especially LED bulbs. At present, a white LED technology can be realized in a variety of ways, mainly in two ways: one is that a blue light technology coordinated with a yellow phosphor so as to form white light; the other is that multiple monochromatic lights are mixed to obtain white light. Since the driving voltage, the light output, the temperature characteristics and the lifetime of different color LEDs are different, a multi-color hybrid white LED is complicated in production and high in cost. Manufacturers generally use the first technology.

However, it may bring more harm when there is too much blue light in an LED bulb. The light source has a great influence on the physiology and behavior of a human body. Excessive blue light inhibits melatonin and increases stress hormone cortisol, which interferes with physiological mechanisms. In addition to affecting sleep, it may damage the retina and cause other diseases. In the blue light spectrum, the wavelength of 400 to 450 nm is most likely to cause retinal damage, which can penetrate through the lens of a human eye to reach the retina, and cause photochemical damage to the retina. There are even studies show the relationship of blue light to breast cancer. Japanese studies have found that all blue light radiation larger than 20 $J \cdot cm^{-2}$ causes significant fundus changes. Moreover, the lens of the human eye gradually develops with the age of the person since its formation. Therefore, the greatest risk of blue light hazards occurs in infants and young children. At this time, the underdeveloped lens of the human eye has a high transmittance for short-wavelength spectral radiation, which is several times that of an adult's eye. Short-wave blue light is more likely to reach the retina through the lens of such a person, thereby accelerating oxidation of cells in the macular area of the retina. Although the lens of an adult's eye has a low transmittance to blue light, long-term exposure to blue light will cause degeneration of the retina and form photo retinitis. Therefore, in LED products, blue light leakage is absolutely not allowed.

In order to realize $4\pi$ light emitting, most products use a transparent substrate, so that light emitted by the LED chip is light emitted in $4\pi$. The existing LED filament generally adopts a blue LED chip coated with a yellow phosphor to achieve the effect of emitting white light. However, the main component of the phosphor is generally silica gel, and the heat conductivity coefficient of the silica gel is only 0.2 $W/(m \cdot K)$. The generated heat is even hard to be dissipated. If the filament is not completely coated, since the substrate is transparent, the uncoated portion will leak blue light, causing damage to the human eye. On the other hand, in the case where the filament is completely coated, a large amount of heat generated by the LED chip is hard to be dissipated, and when the temperature exceeds a certain temperature in use, the silica gel cracks, which may also cause blue light leakage.

In addition to the problem of heat dissipation and blue light leakage, the existing LED filament lamp generally adopts a core column with a bracket, which is a glass bracket extending into the center of the bulb, and the LED filament is dispersed and fixed on the glass bracket. The LED filament is a fine and tiny industrial part product, and only automated machine production can maintain their consistency and reliability. Therefore, the production of a filament substrate, the mounting of pins and brackets, the die bonding of LED beads, the connection of gold wires, and the coating of phosphors should be automatically completed in an industrial automatic production machine. For an existing LED filament, one end is soldered to the upper end of a bracket, and the other end is soldered to the lower end of a core base. Soldering points are divided into upper and lower ends, and the existing LED filaments are generally in series or series-parallel connection to meet the voltage requirement, which requires more LED filaments, the soldering points are further increased, and the wick assembly is more complicated.

In summary, in order to further develop LED filament lamps, the prior art has yet to be further improved and developed.

SUMMARY OF THE INVENTION

The present invention is directed to solving at least one aspect of the above problems and deficiencies that exist in the prior art. Accordingly, the present invention is directed to an LED filament lamp and an LED lighting bar thereof, which are excellent in heat dissipation performance, low in production cost, high in luminous efficiency, good in luminous effect, and energy-saving and environmentally friendly. In order to solve the above problems, the technical solution of the present invention is as follows:

An LED filament lamp using infrared radiation heat dissipation comprises a bulb shell with an infrared transmittance larger than 0.8; a core base with an exhaust pipe; a driver; a lamp cap; and at least one LED lighting bar with a 2π light-emitting LED chip; the bulb shell and the core base are in vacuum sealing to form a vacuum sealed cavity and the vacuum sealed cavity filled with high heat conductivity gas; the LED lighting bar is located in the vacuum sealed cavity, one side of the LED lighting bar is provided with a light-emitting layer of the LED chip, and the other side is provided with an infrared radiation converting layer; and both ends of the LED lighting bar are fixed to the core base through a metal wire respectively, and are connected to the driver, which is fixed below the core base; and the driver and the lamp cap are connected in series through an outer electrode leading-out wire.

In the LED filament lamp using infrared radiation heat dissipation, the infrared radiation converting layer may include a bonding material and a radiation cooling material, the bonding material is selecting from one or more of silica gel, epoxy resin, plastic, transparent glue, transparent paint and polymer, and the radiation cooling material is made from a mixture of a radiation material with an infrared emissivity larger than 0.8 and a high heat conductivity material.

According to the above LED filament lamp using infrared radiation heat dissipation, the radiation material with an infrared emissivity larger than 0.8 may include any one of mica powder, aluminium oxide, mullite, silicon oxide, and silicon carbide.

According to the above LED filament lamp using infrared radiation heat dissipation, the high heat conductivity material may be selected from one or more of graphite, carbon black, graphene, carbon nanotube, boron nitride, aluminum oxide, aluminum nitride, silicon nitride, magnesium oxide, and heat conducting ceramic powder.

According to the above LED filament lamp using infrared radiation heat dissipation, the LED lighting bar may be in an inverted V shape ("∧"), an inverted U shape ("∩"), an arc shape, a trapezoid shape or a right-angled U shape ("⊔") as a whole. According to the above LED filament lamp using infrared radiation heat dissipation, there may be at least two LED lighting bars, connected in parallel with each other, the middle parts of the lighting bars are connected by an insulating layer, and in crossed arrangement.

According to the above LED filament lamp using infrared radiation heat dissipation, the middle part of the LED lighting bar may be provided with a through hole, and the insulating layer is provided, at the corresponding position, with a lug boss matched with the through hole.

According to the above LED filament lamp using infrared radiation heat dissipation, the driver may be coated with an insulating heat conducting mud, and the insulating heat conducting mud is connected to the lamp cap, which is made from a mixture of the bonding material and the high heat conductivity material.

According to the above LED filament lamp using infrared radiation heat dissipation, the bulb shell with an infrared transmittance larger than 0.8 may be a silicate-based glass bulb shell.

In the LED filament lamp using infrared radiation heat dissipation, the bulb shell may use an A-type bulb shell, a G-type bulb shell, a PAR-type bulb shell, a T-type bulb shell, a candle-type bulb shell, a P-type bulb shell, a PS-type bulb shell, a BR-type bulb shell, an ER-type bulb shell or a BRL-type bulb shell; and the lamp cap may use E12 type, E14 type, E27 type, E26 type, E40 type, GU type, BX type, BA type, EP type, EX type, GY type, GX type, GR type, GZ type or G type.

According to the above LED filament lamp using infrared radiation heat dissipation, the metal wire may be made of a hard metal.

An LED lighting bar using infrared radiation heat dissipation may include a metal substrate, at least one string of 2π light-emitting LED chips located on the metal substrate and connected in series in the same PN junction direction; the back of the metal substrate is provided with an infrared radiation converting layer, which comprises a bonding material and a radiation cooling material, the bonding material is selected from one or more of silica gel, epoxy resin, plastic, transparent glue, transparent paint and polymer, and the radiation cooling material may be selected from one or more of graphite, carbon black, graphene, carbon nanotube, boron nitride, aluminum oxide, aluminum nitride, silicon nitride, magnesium oxide, heat conducting ceramic powder, and mica powder.

According to the above LED lighting bar using infrared radiation heat dissipation, the radiation cooling material may be made of a mixture of mica powder and a high heat conductivity material, the high heat conductivity material is one or more of graphite, carbon black, graphene, carbon nanotube, boron nitride, aluminum oxide, aluminum nitride, silicon nitride, magnesium oxide, and heat conducting ceramic powder.

According to the above LED lighting bar using infrared radiation heat dissipation, the metal substrate may be in an inverted V shape ("∧"), an inverted U shape ("∩"), an arc shape, a trapezoid shape or a right-angled U shape ("⊔") as a whole.

According to the above LED lighting bar using infrared radiation heat dissipation, the LED chips may be distributed on both outer sides of the metal substrate.

According to the above LED lighting bar using infrared radiation heat dissipation, the LED chip may be one of a blue LED chip, a red LED chip, a green LED chip, a yellow LED chip, a violet LED chip, or any combination thereof.

According to the above LED lighting bar using infrared radiation heat dissipation, a surface of the metal substrate with the LED chip may be provided with a phosphor layer, the phosphor layer comprises a phosphor and a transparent medium, the transparent medium comprises one or more of silica gel, epoxy resin, plastic, transparent glue, transparent paint and polymer.

According to the above LED lighting bar using infrared radiation heat dissipation, the phosphor may be any combination of YAG-series yellow powder, YAG-series yellow green powder, or silicate-series yellow powder, silicate-series yellow green powder, silicate-series orange powder, or nitride-series red powder, nitrogen oxide-series red powder, or YAG-series phosphors, silicate-series phosphors, nitride-series phosphors, and nitrogen oxide-series phosphors.

According to the above LED lighting bar using infrared radiation heat dissipation, the infrared radiation converting layer may be further doped with reflective powder.

According to the above LED lighting bar using infrared radiation heat dissipation, the reflective powder may have a color similar to that of the phosphor layer.

Advantageous effects of the present invention include:

The disclosure of the present invention is excellent in dissipation performance. The present invention integrates heat dissipation manners such as heat conduction, gas convection heat dissipation and radiation heat dissipation, forms a heat dissipation system with an outstanding heat dissipation effect, and comprehensively enhances the heat dissipation performance of the LED lighting bar and the LED filament lamp. The heat of the LED filament lamp mainly comes from an LED chip and a power device on a driver. For heat generated by the LED chip, firstly, the LED lighting bar uses a metal substrate which has excellent conduction heat dissipation performance, as the heat conductivity coefficient of metal is at least dozens of times that of glass and the like, the heat generated by the LED chip may be conducted very quickly; secondly, an infrared radiation converting layer is coated on the inner side of the metal substrate of the LED lighting bar, and a silicate-based glass bulb shell with a high infrared transmittance is used, the heat conducted via the metal substrate is converted into an infrared wave of 2 to 20 μm by the infrared radiation converting layer according to the principle of radiation heat dissipation, and then the infrared wave is directly transmitted to an external environment via the bulb shell with a high infrared radiation transmittance. In addition, the bulb shell is filled with a gas of high heat conductivity, and the heat is dissipated through gas convection. For the power device on the driver, the driver is coated with an insulating heat conducting mud and is connected to the lamp cap through the insulating heat conducting mud, so heat generated on the driver is conducted to a metal wall of the lamp cap through the insulating heat conducting mud and is dissipated through the lamp cap. By the heat dissipation system of the present invention, under the same conditions, the working temperature of each LED lighting bar can be reduced by 10 to 12° C. compared with an LED filament lamp not coated with an infrared radiation heat dissipation material.

The disclosure of the present invention has high luminous efficiency. Through the all-round heat dissipation design, the LED filament lamp is greatly reduced in temperature compared with the LED filament lamp in the prior art, and the luminous efficiency is further improved as the temperature is lowered. A common LED filament lamp, i.e. A60 type, can only achieve the upper limit of 806 lm in the past, and the same type of LED filament lamp provided by the present invention can be increased to 15201 lm.

The disclosure of the present invention is not liable to leak blue light. The LED lighting bar of the present invention is in 2π light emitting, and only needs to be coated with a phosphor layer on one side of the bar to ensure that no blue light is leaked, while the LED filament with a transparent substrate must ensure that the filament is completely coated by the phosphor layer so as not to leak blue light.

The disclosure of the present invention is simple in manufacturing process and easy to mechanize the assembly of the filament. The LED lighting bar provided by the present invention uses an inverted V shape ("∧"), an inverted U shape ("∩"), an arc shape, a trapezoid shape or a right-angled U shape ("⊔") structure, one LED lighting bar is equivalent to two lighting bars of the prior art, and both ends of the LED lighting bar can be directly fixed on the same plane of a core base, which is easy to mechanize the assembly of the filament. The core base eliminates a narrow bracket or pillar, and reduces the soldering points, thereby simplifying the production process and improving the production efficiency.

The disclosure of the present invention is low in cost. On one hand, one LED lighting bar provided by the present invention is equivalent to two lighting bars in the prior art. On the other hand, a metal substrate is used instead of an expensive sapphire or diamond substrate, so that the production cost is reduced.

The disclosure of the present invention has excellent visual effect. When an ordinary 2π light-emitting LED filament is not working, there is obvious chromatic aberration on the back of the filament, which affects the visual effect. The infrared radiation converting layer is coated on the back side, and furthermore, reflective powder is doped, so that the color of the inner and outer materials of the LED lighting bar is kept consistent, and no chromatic aberration is formed on the back of the metal substrate, so that the visual effect is improved.

The disclosure of the present invention is energy-saving and environment-friendly. The radiation cooling material of the present invention preferably uses a mixture of mica powder and a high heat conductivity material, so the heat can be converted into an infrared wave of 2 to 20 μm and radiated into the surrounding environment without causing pollution to the environment.

DESCRIPTION OF THE DRAWING REFERENCE SIGNS

Figure 1:
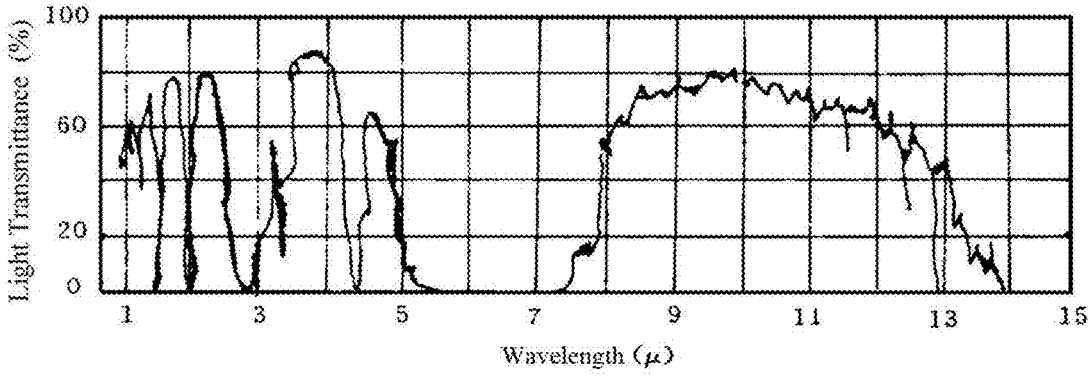
FIG. 1 is a transmission spectrum diagram of the atmosphere.

1, LED lighting bar; 101, through hole; 102, metal substrate; 103, LED chip; 104, infrared radiation converting layer; 105, electrode leading-out device; 106, phosphor layer; 107, insulating material; 2, core base; 201, exhaust pipe; 3, bulb shell; 4, metal wire; 5, lamp cap; 6, driver; 7, external electrode leading-out wire; 8, insulating layer; 801, lug boss; 12, insulating heat conducting mud.

DETAILED DESCRIPTION OF THE INVENTION

Implementations of the present invention are described in detail below, and the examples of the implementations are illustrated in the drawings, where the same or similar reference numerals throughout indicate the same or similar elements or elements having the same or similar functions. The implementations described below with reference to the drawings are exemplary, only intended to be illustrative of the present invention and not to be construed as limiting to the present invention.

In the description of the present invention, it should be understood that orientation or position relationships indicated by the terms such as "center", "longitudinal", "transverse", "length", "width", "thickness", "up", "down", "front", "rear", "left", "right", "vertical", "horizontal", "top", "bottom", "inside", and "outside" are based on orientation or position relationships shown in the accompanying drawings, and are used only for ease and brevity of illustration and description of the present invention, rather than indicating or implying that the mentioned device or component must have a particular orientation or must be constructed and operated in a particular orientation. Therefore, such terms should not be construed as limiting to the present invention. In the description of the present invention, it should be noted that unless otherwise explicitly specified or defined, the terms such as "mount", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. A person of ordinary skill in the art may understand the specific meanings of the foregoing terms in the present invention according to specific situations.

In the present invention, unless otherwise explicitly specified or defined, the expression that a first feature is "on" or "beneath" a second feature may include that the first and second features are in direct contact, and may also include that the first and second features are not in direct contact but contact through additional features therebetween. Moreover, the expression that the first feature is "above" and "over" the second feature includes that the first feature is right above and diagonally above the second feature, or merely indicates that the first feature level is higher than the second feature. Moreover, the expression that the first feature is "below" and "under" the second feature includes that the first feature is right below and diagonally below the second feature, or merely indicates that the first feature level is lower than the second feature.

The following disclosure provides many different implementations or examples for implementing different structures of the present invention. In order to simplify the disclosure of the present invention, the components and arrangements of specific examples are described below. Of course, they are merely examples and are not intended to limit the present invention. In addition, the present invention may repeat reference numbers and/or reference letters in various examples, which are for the purpose of simplicity and clarity, and do not indicate a relationship between various implementations and/or arrangements discussed. In addition, the present invention provides examples of various specific processes and materials, but a person of ordinary skill in the art will recognize the application of other processes and/or the use of other materials.

Figure 2:
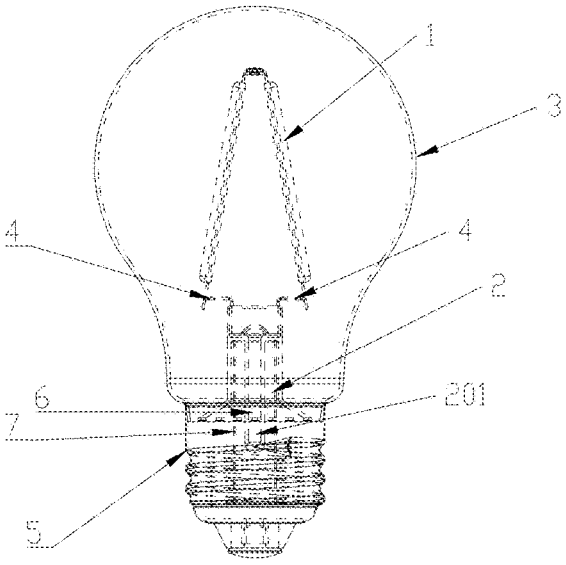
FIG. 2 is a schematic structure diagram of an LED filament lamp provided by the present invention.
Figure 11:
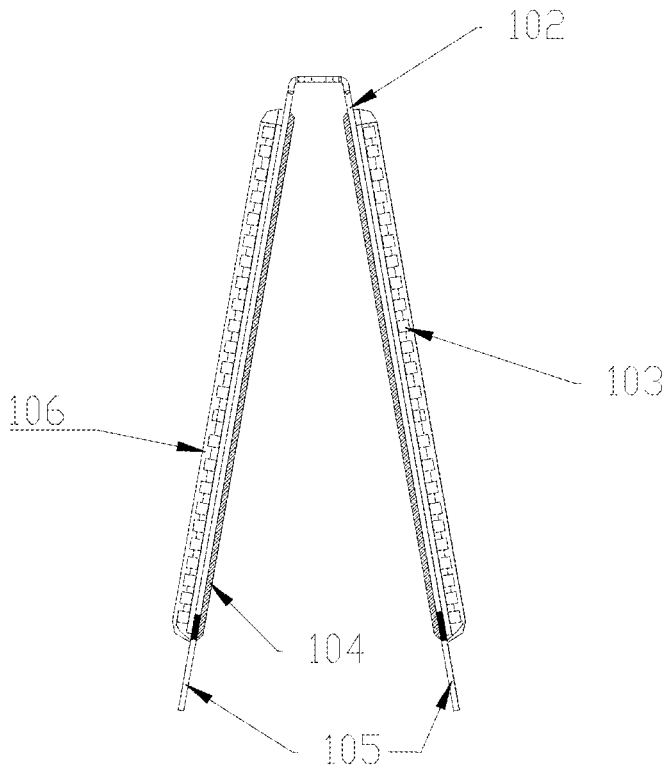
FIG. 11 is a schematic structure diagram of an LED lighting bar provided by the present invention.
Figure 12:
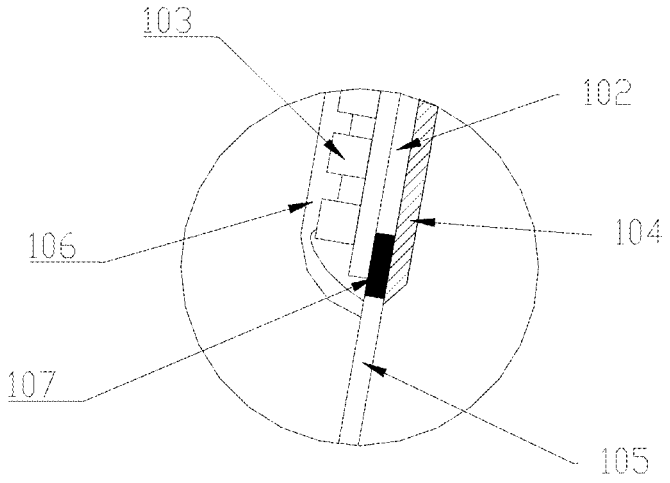
FIG. 12 is a partial enlarged view of an LED lighting bar provided by the present invention.

Referring to FIG. 2 and FIG. 11, which are schematic structure diagrams of an LED filament lamp and an LED lighting bar provided by the present invention, the LED filament lamp comprises a bulb shell (3), a core base (2) with an exhaust pipe (201), a driver (6), a lamp cap (5), and at least one LED lighting bar (1) with 2π light-emitting LED chip. The bulb shell (3), the core base (2) with the exhaust pipe (201), the driver (6), the lamp cap (5) and the LED lighting bar (1) are integrally connected to each other as the LED filament lamp. The bulb shell (3) and the core base (2) are in vacuum sealing to form a vacuum sealed cavity, which is filled with high heat conductivity gas. The LED lighting bar (1) is located in the vacuum sealed cavity, one side of the LED lighting bar (1) is provided with an LED chip (103), and the other side is provided with an infrared radiation converting layer (104). Both ends of the LED lighting bar (1) are connected to the driver (6) through a metal wire (4) respectively, the driver (6) is fixed below the core base (2), and the driver (6) and the lamp cap (5) are connected in series through an outer electrode leading-out wire (7). The present invention integrates heat dissipation manners such as heat conduction, gas convection heat dissipation and radiation heat dissipation to form a heat dissipation system with an outstanding heat dissipation effect, and comprehensively enhances the heat dissipation performance of the LED lighting bar and the LED filament lamp. For heat generated by the LED chip, firstly, the LED lighting bar (1) uses a metal substrate (102) which has excellent conduction heat dissipation performance, the heat conductivity coefficient of metal is at least dozens of times that of glass and the like, so that the heat generated by the LED chip can be conducted very quickly; secondly, the infrared radiation converting layer (104) is coated on the inner side of the metal substrate (102) of the LED lighting bar (1), the bulb shell (3) with an infrared transmittance larger than (0.8) is adopted, the heat conducted via the metal substrate (102) is converted into an infrared wave of 2 to 20 μm through the infrared radiation converting layer (104) according to the principle of radiation heat dissipation, and then the infrared wave is directly transmitted to an external environment via the bulb shell (3) with an infrared radiation transmittance larger than 0.8. In addition, the bulb shell (3) is filled with a gas of high heat conductivity, and the heat is dissipated through gas convection.

In practical applications, the infrared radiation converting layer (104) is made from a mixture of a bonding material and a radiation cooling material, the bonding material is one or more of silica gel, epoxy resin, plastic, transparent glue, transparent paint and polymer, and the radiation cooling material is made from a mixture of a radiation material with an infrared emissivity larger than 0.8 and a high heat conductivity material. Preferably, a mass ratio of the bonding material to the radiation cooling material may be 1:1.

Further, the radiation material with an infrared emissivity larger than 0.8 comprises any one of mica powder, aluminium oxide, mullite, silicon oxide, and silicon carbide. The mica powder may be white mica powder or sericite or the like. In addition to the materials listed above, other radiation materials that can be foreseen by those skilled in the art having an infrared emissivity larger than 0.8 should also fall within the scope of protection of the present invention.

Refer to Table 1 for the infrared emissivity of common metal and non-metal oxides at 100° C. For the LED lighting bar, the working temperature is around 100° C. Therefore, it is necessary to consider a radiator having a high emission performance under normal working conditions (below 100° C.). Most commonly used metal and non-metal oxides have an infrared emissivity of about 80% at 100° C.

TABLE 1

Infrared Emissivity of Common Metal and Non-Metal Oxides at 2-22 μm Wavelength (100° C.)

| Material | Emissivity (100%) | Material | Emissivity (%) |
|---|---|---|---|
| $Al_2O_3$ | 88 | $Cr_2O_3$ | 79 |
| $CeO_2$ | 79 | $Co_2O_3$ | 81 |
| $Fe_2O_3$ | 74 | MgO | 80 |
| $Sb_2O_3$ | 87 | SiC | 81 |
| $SiO_2$ | 83 | $TiO_2$ | 82 |
| Mullite ($3Al_2O_3 \cdot 2SiO_2$) | 82 | ZnO | 79 |
| Sericite | 88 | | |

The infrared radiation performance of some material at 50° C. is further tested to show that the infrared emissivity of different materials varies with the decrease of the test temperature, wherein the emissivity of sericite and aluminium oxide ($Al_2O_3$) is further improved, most of bands exceed 90%, and the emissivity of zinc oxide (ZnO) is significantly reduced. Referring to Table 2.

TABLE 2

Infrared Emissivity of Some materials at 50° C. (%)

| Wavelength (μm) | ≤8 | 8.55 | 9.50 | 10.6 | 12.0 | 13.5 | ≤14 | Full wave (2-22) |
|---|---|---|---|---|---|---|---|---|
| $Al_2O_3$ | 93 | 94 | 95 | 95 | 94 | 94 | 92 | 91 |
| Sericite | 91 | 87 | 87 | 92 | 94 | 93 | 93 | 88 |
| ZnO | 38 | 29 | 35 | 36 | 31 | 39 | 42 | 40 |

The infrared emissivity of an oxide mixture is obtained by mechanically mixing metal and non-metal oxides in different mass ratios, referring to Table 3. By directly testing of the radiation performance, it is found that the infrared emissivity of the mixture is usually lower than the highest infrared emissivity of its constituent materials. Therefore, in order to obtain high-emissivity infrared materials, it is generally necessary to use a material having a higher emissivity as a raw material.

TABLE 3

Infrared Emissivity of Oxide Mixture (%)

| Main components (arranged according to quality sequence) | 100° C. | 50° C. Full band | ≤8 | 8.55 | 9.50 | 10.6 | 12.0 | 13.5 | ≤14 |
|---|---|---|---|---|---|---|---|---|---|
| Magnesium, titanium | 78 | 78 | 78 | 64 | 75 | 79 | 93 | 95 | 92 |
| Aluminum, silicon | 86 | 91 | 94 | 94 | 95 | 95 | 94 | 93 | 91 |
| Titanium, silicon, aluminum | 84 | 87 | 93 | 94 | 94 | 93 | 94 | 92 | 90 |
| Iron, manganese, cobalt | 83 | 60 | 62 | 48 | 56 | 60 | 58 | 74 | 61 |
| Titanium, mullite, silicon | 83 | 89 | 94 | 96 | 96 | 96 | 95 | 92 | 92 |

TABLE 3-continued

| Infrared Emissivity of Oxide Mixture (%) | | | | | | | | | |
|---|---|---|---|---|---|---|---|---|---|
| Main components | | 50° C. | | | | | | | |
| (arranged according to quality sequence) | 100° C. | Full band | ≤8 | 8.55 | 9.50 | 10.6 | 12.0 | 13.5 | ≤14 |
| Chromium, zirconium, iron, silicon | 84 | 84 | 87 | 83 | 89 | 93 | 95 | 94 | 92 |
| Aluminum, magnesium, titanium, mullite | 85 | 87 | 90 | 86 | 92 | 95 | 95 | 94 | 91 |
| Aluminum, magnesium, titanium, mullite | 85 | 87 | 90 | 86 | 92 | 95 | 95 | 94 | 91 |
| Titanium, zirconium, manganese, iron, chromium, nickel | 84 | 68 | 77 | 63 | 73 | 79 | 91 | 87 | 85 |

Note:
The full band is 2-22 μm.

As can be seen from Table 1 and Table 2, preferably, mica powder and aluminium oxide are selected as radiation materials. It has been proved by experiments that mica powder and aluminium oxide have excellent infrared radiation performance which is much better than the above-mentioned radiation cooling material. In particular, mica powder and aluminium oxide can convert heat into infrared waves of specific bands, i.e., infrared waves of 2 to 20 μm, which can be directly transmitted to the surrounding environment. However, mica powder does not have good heat conductivity, and the heat conducted through the metal substrate cannot be effectively conducted to the mica powder.

In order to solve this problem, in the present invention, mica powder is mixed with a high heat conductivity material, so that heat can be more efficiently transmitted to the mica powder, thereby being converted into an infrared wave and radiated. The mica powder body has more chemical functional bonds in the surface and is of a layered structure, which can be well combined with the high heat conductivity material, is a very good dispersant and can also solve the huddling problem of high heat conductivity materials. Preferably, by mass percentage, the mica powder may be 1-99%; and the high heat conductivity material may also be 1-99%. The high heat conductivity material may be one or more of graphite, carbon black, graphene, carbon nanotube, boron nitride, aluminum oxide, aluminum nitride, silicon nitride, magnesium oxide, and heat conducting ceramic powder.

In particular, the mica powder has a rough surface and is of a layered structure. When the particle size is small enough, the specific surface area is large, and the larger the specific surface area, the higher the infrared radiance, which is one of the reasons why the mica powder is preferred.

Referring to FIG. 2 to FIG. 9, the LED lighting bar provided by the present invention may be in an inverted V shape ("∧"), an inverted U shape ("∩"), an arc shape, a trapezoid shape or a right-angled U shape ("⊔") or other irregular shapes as a whole. As shown in FIG. 2, in this embodiment, the LED lighting bar (1) is trapezoid, both ends are at the lower end, the middle portion is located at the upper end inside the bulb shell (3), both ends of the LED lighting bar (1) are connected in series to the driver (6) through an electric leading-out wire (4) respectively, the driver (6) is fixed on the core base (2), and the driver (6) and the lamp cap (5) are connected in series by an external electrode leading-out wire (7). In this embodiment, the core base (2) does not have elongated pillars or brackets that extend into the bulb shell and are used for fixing the LED filament in the prior art. The fixing points of the LED lighting bar (1) are all on the same plane at the upper end of the core base (2). In the wick assembly process, the LED lighting bar (1) can be directly soldered to the upper end of the core base (2) through the electric leading-out wire (4), which is easy to mechanize and simplifies the production process. The length of the LED lighting bar in the prior art is only about half of that of the LED lighting bar (1) provided by the present invention, and both ends cannot be directly connected to the driver (6) at the same time. To meet the needs of the applicable voltage, it is required that two LED lighting bars are connected in series at the tops of the pillars of the core base, and then the remaining ends of the two LED bars are connected to the driver (6), so that the production process is complex and complicated. The present invention only needs one LED lighting bar (1) to realize the function of the original two LED lighting bars, and does not need complicated operations such as soldering and series connection between the LED lighting bars.

Figure 3:
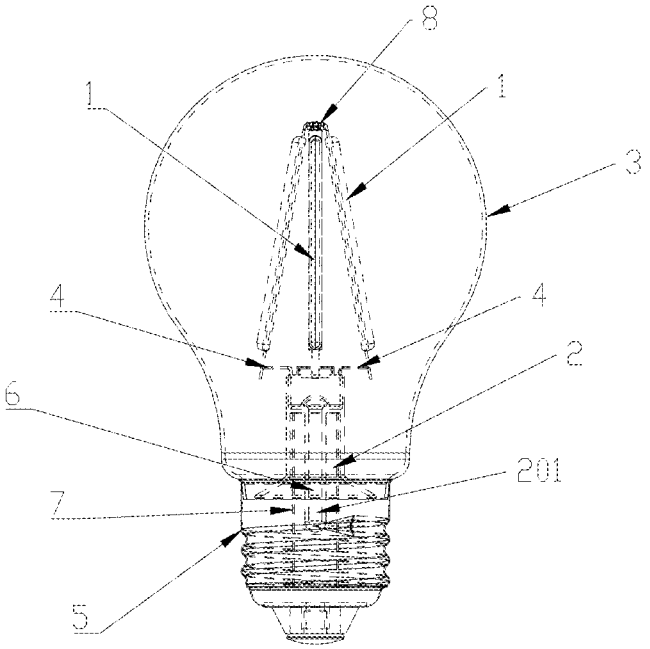
FIG. 3 is a schematic structure diagram of another LED filament lamp provided by the present invention.
Figure 8:
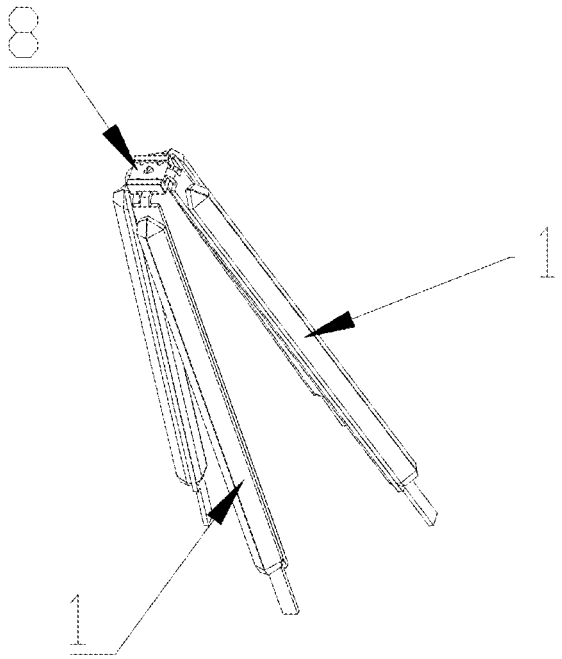
FIG. 8 is a partial schematic structure stereogram of an LED lighting bar of an LED filament lamp provided by the present invention.
Figure 9:
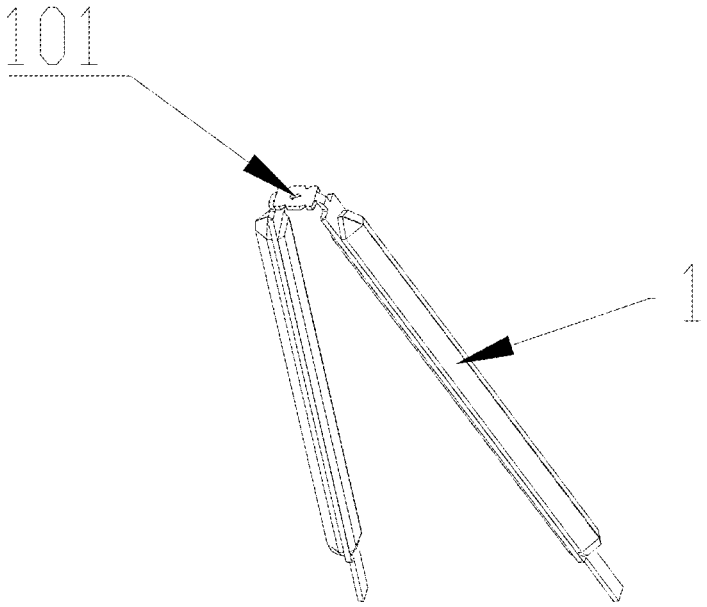
FIG. 9 is a schematic structure stereogram of an LED lighting bar of an LED filament lamp provided by the present invention.
Figure 10:
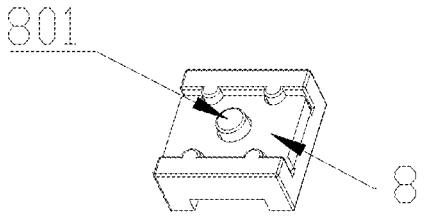
FIG. 10 is a schematic structure stereogram of an insulating layer provided by the present invention.

In practical applications, the number of LED lighting bars (1) may be plural. As shown in FIG. 3, in this embodiment, the number of LED lighting bars (1) is 2, which are in crossed arrangement, the tail ends are connected to the driver (6) through the electric leading-out wire (4), and the two LED lighting bars (1) are connected in parallel. When a plurality of LED lighting bars (1) are in crossed arrangement, an insulating layer (8) may be set at a middle crossed portion of the LED lighting bar (1) to ensure that different LED lighting bars do not interfere with each other. Furthermore, as shown in FIG. 8 to FIG. 10, a through hole (101) may be provided in the middle of the LED lighting bar (1) in the upper layer to be adapted to a lug boss (801) on the insulating layer (8). In practical applications, the insulating layer (8) is mounted on the LED lighting bar (1) in the lower layer, then the LED lighting bar (1) in the upper layer is mounted, and the lug boss (801) passes through the through hole 101, thereby further enhancing the firmness of the LED lighting bar (1).

In practical applications, the bulb shell (3) and the core base (2) are fusing-sealed at the junction pint where they are bonded by high temperature heating treatment to form a vacuum sealed cavity, and the process thereof is the same as that of the conventional incandescent lamp sealing process, and will not be described herein. At the time of sealing, the LED lighting bar (1) is also sealed into the vacuum sealed cavity. After the vacuum sealed cavity is evacuated through the exhaust pipe (201), high heat conductivity gas is charged. The high heat conductivity gas may be one or more of helium, hydrogen, nitrogen, and argon. When the gas is used, effective convection heat dissipation can be formed, and the heat is dissipated through the bulb shell. In practical applications, referring to FIG. 2 or FIG. 3, the exhaust pipe (201) is located inside the core base (2), and the end port of the exhaust pipe (201) is provided with a sealing head.

Referring to FIG. 2, the core base (2) of the present invention is different from the existing core column. The core base (2) of the present invention does not comprise a bracket, and both ends of the LED lighting bar (1) are fixed on the same plane of the core base (2) by the metal wire (4), and the soldering joints are few, which simplifies the production process. Preferably, the metal wire (4) may be made of a hard metal to enhance its mechanical strength and ensure the fixing stability of the LED lighting bar (1).

Figure 4:
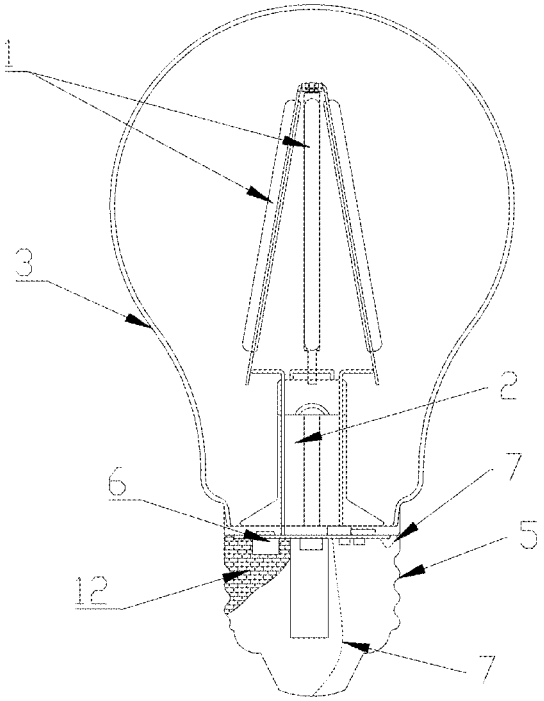
FIG. 4 is a schematic structure diagram of an LED filament lamp using an insulating heat conducting mud provided by the present invention.
Figure 5:
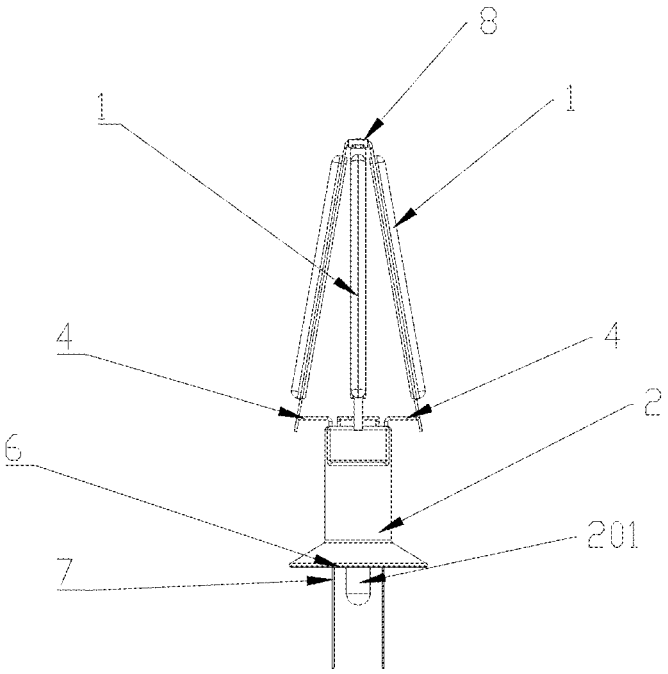
FIG. 5 is a partial schematic structure diagram of an LED filament lamp provided by the present invention.
Figure 6:
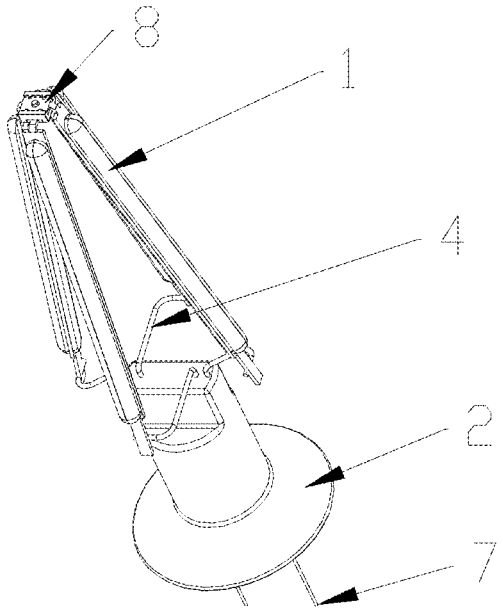
FIG. 6 is a partial schematic structure stereogram of an LED filament lamp provided by the present invention.
Figure 7:
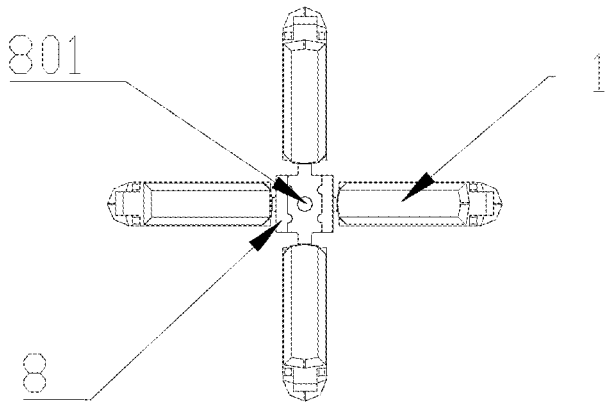
FIG. 7 is a partial schematic top view of an LED filament lamp provided by the present invention.

In practical applications, the driver (6) may include a driver housing and a drive circuit, the drive circuit is located inside the driver housing, and the drive circuit may be any one of a resistor-capacitor voltage-reducing power supply, a linear constant current power supply, or a switching constant current power supply. As shown in FIG. 4, the driver (6) is coated with an insulating heat conducting mud (12), the insulating heat conducting mud (12) is connected to the lamp cap (5), and the insulating heat conducting mud (12) is made from a mixture of the bonding material and the high heat conductivity material. Heat generated by a power device on the driver (6) is conducted to a metal wall of the lamp cap (5) through the insulating heat conducting mud (12) and is dissipated. Preferably, the insulating heat conducting mud (12) may only be coated on the power device of the driver (6).

In practical applications, according to different demands, the bulb shell (3) may be a transparent bulb shell, a milky bulb shell, a frosted bulb shell, a colored bulb shell, a bulb shell with reflecting layers on part of surface, a bulb shell with prisms on part of surface, a bulb shell with lenses on part of surface, or a silicon-based bulb shell. The bulb shell (3) is a silicate-based glass bulb shell, the silicate-based glass bulb shell has a good infrared transmittance, and the infrared transmittance is 0.9 or more. When the heat is converted into an infrared wave, it can be efficiently and easily transmitted.

Figure 19:
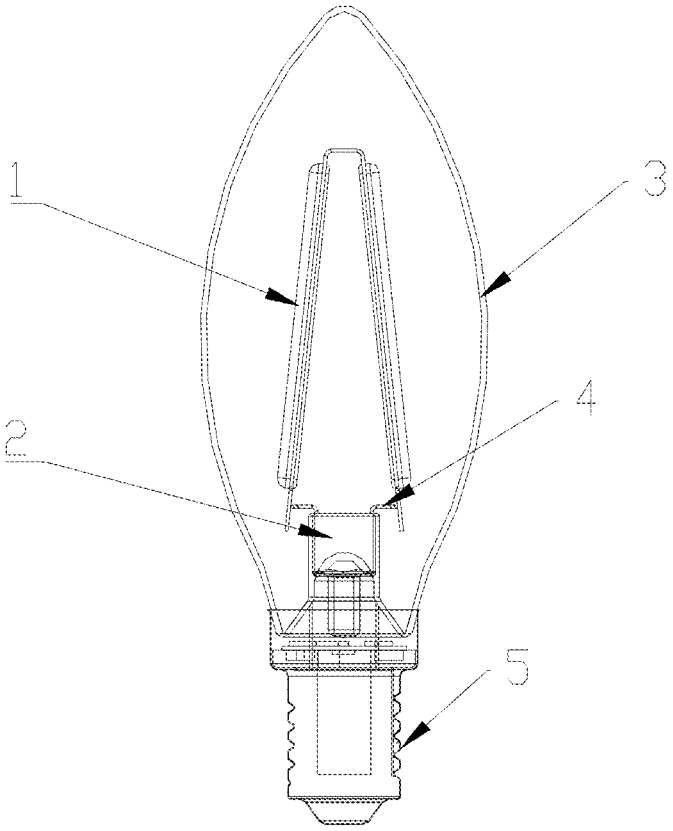
FIG. 19 is a structure diagram of a C35 type LED filament lamp provided by the present invention.
Figure 20:
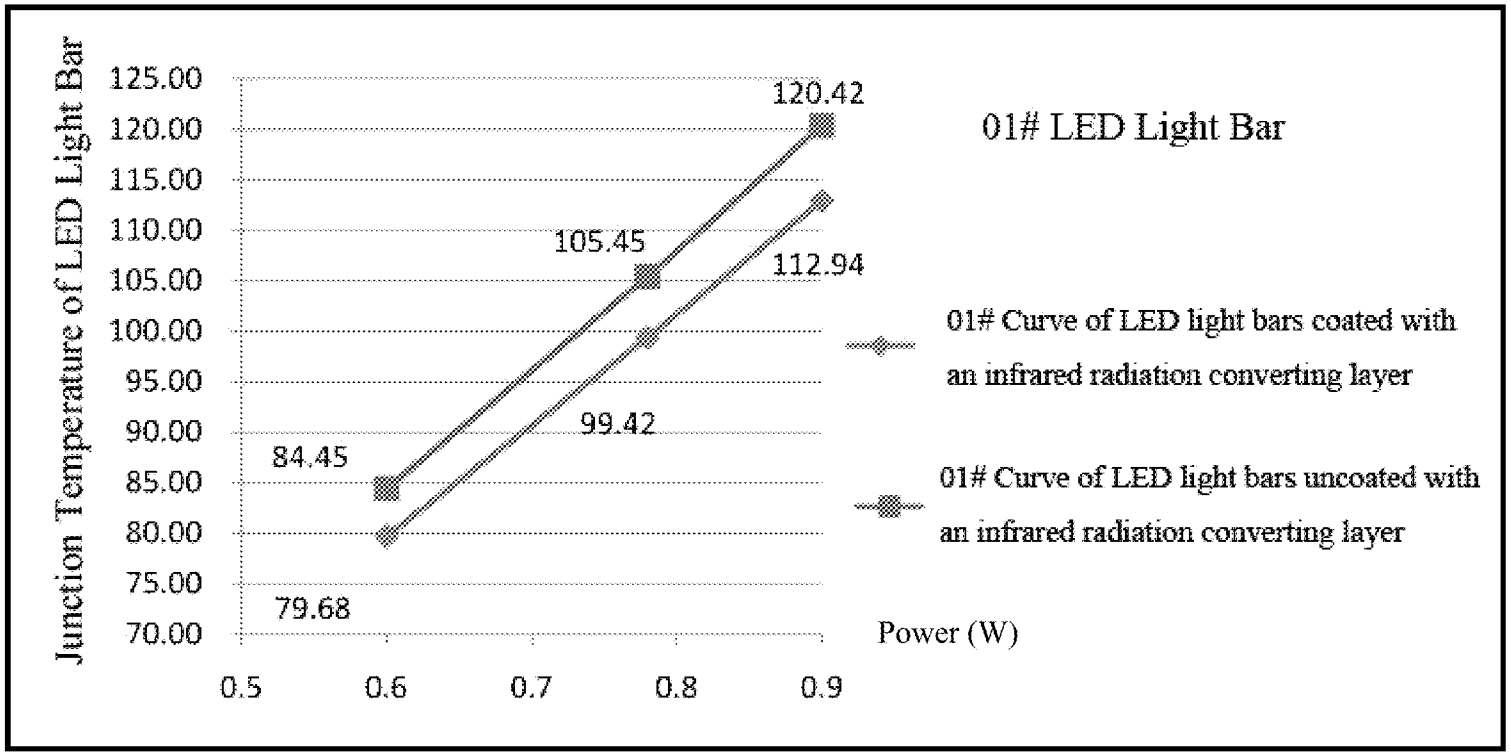
FIG. 20 is a comparison diagram of a junction temperature of a first batch of LED lighting bars coated with an infrared radiation converting layer and a chip uncoated with an infrared radiation converting layer provided by the present invention.
Figure 21:
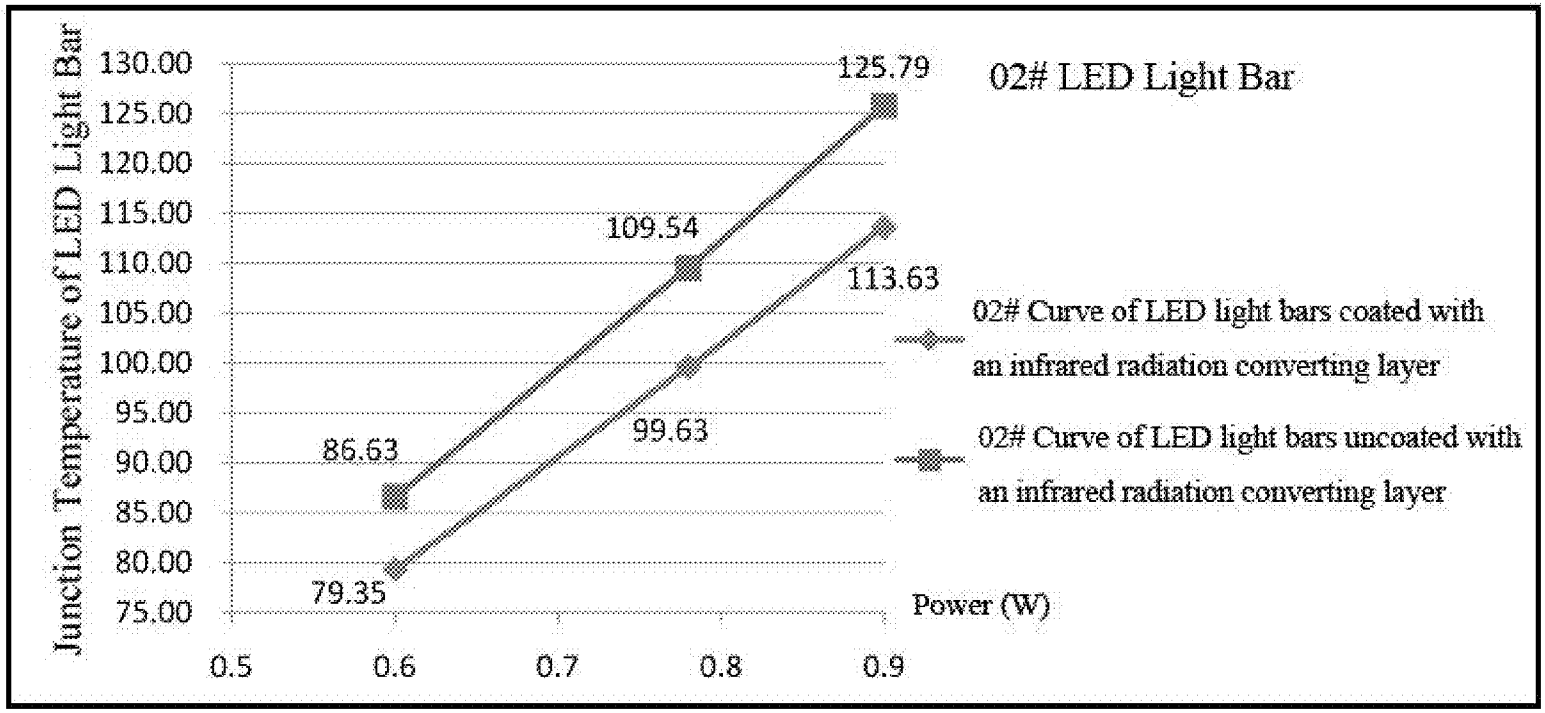
FIG. 21 is a comparison diagram of a junction temperature of a second batch of LED lighting bars coated with an infrared radiation converting layer and a chip uncoated with an infrared radiation converting layer provided by the present invention.
Figure 22:
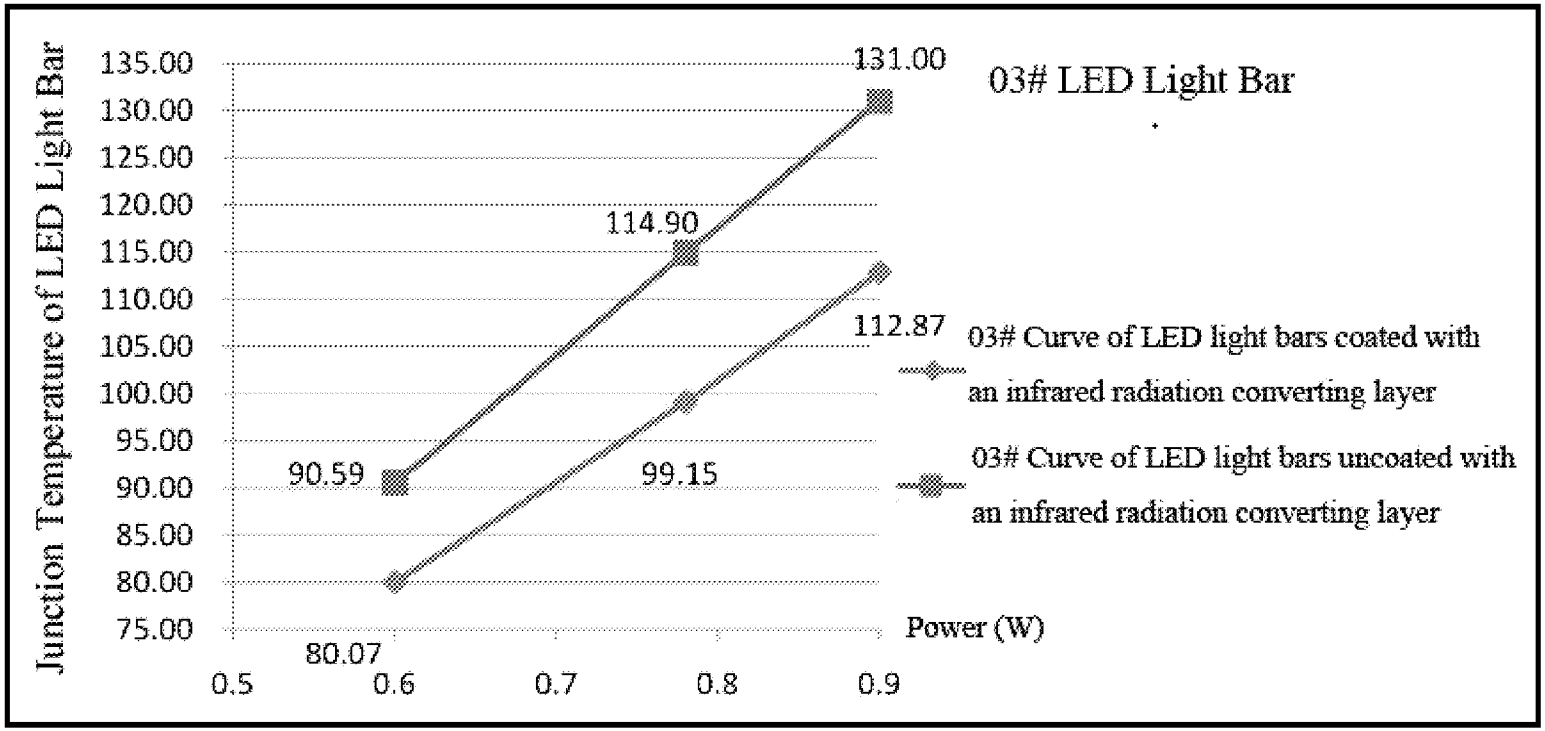
FIG. 22 is a comparison diagram of a junction temperature of a third batch of LED lighting bars coated with an infrared radiation converting layer and a chip uncoated with an infrared radiation converting layer provided by the present invention.
Figure 23:
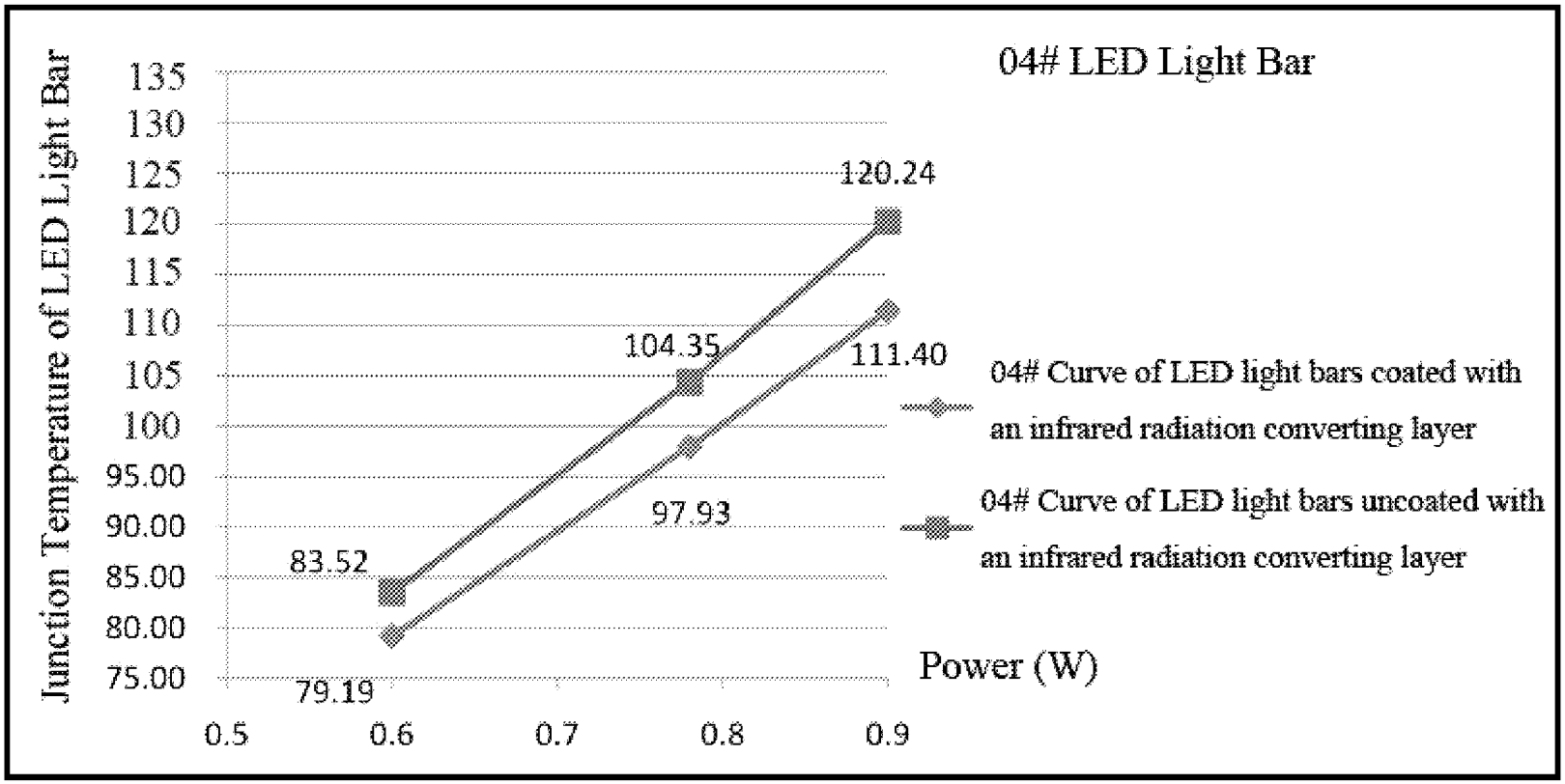
FIG. 23 is a comparison diagram of a junction temperature of a fourth batch of LED lighting bars coated with an infrared radiation converting layer and a chip uncoated with an infrared radiation converting layer provided by the present invention.

In practical applications, according to different demands, the bulb shell (3) may use an A-type bulb shell, a G-type bulb shell, a PAR-type bulb shell, a T-type bulb shell, a candle-type bulb shell, a P-type bulb shell, a PS-type bulb shell, a BR-type bulb shell, an ER-type bulb shell or a BRL-type bulb shell; and the lamp cap may use E12 type, E14 type, E27 type, E26 type, E40 type, GU type, BX type, BA type, EP type, EX type, GY type, GX type, GR type, GZ type or G type, so as to be suitable for different lamp holders. As shown in FIG. 2 or FIG. 3, the bulb shell 3 in these embodiments adopts an A60 type bulb shell, and as shown in FIG. 19, this embodiment uses a C35 type bulb shell 3, which is also called a candle-type bulb shell.

Figure 13:
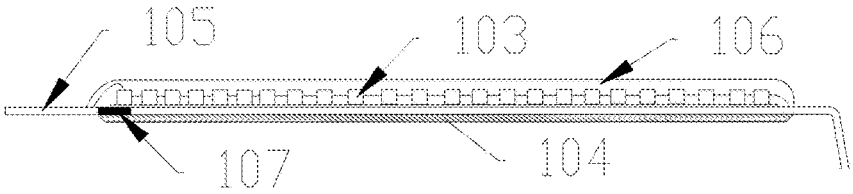
FIG. 13 is a partial enlarged view of an LED lighting bar with one side laid flat provided by the present invention.

FIG. 11 to FIG. 18 are a schematic structure diagram or a partial enlarged view of different forms of LED lighting bars provided by the present invention. Referring to FIG. 11 to FIG. 14, an LED lighting bar provided by the present invention includes a metal substrate (102), and at least one string of LED chips (103) located on the metal substrate (102) and connected in series in the same PN junction direction. Both ends of the metal substrate (102) are provided with an electrode leading-out device (105) separately. The electrode leading-out device (105) is fixedly connected to both ends of the metal substrate (102) via an insulating material (107), and the LED chips (103) are connected in series to the electrode leading-out device (105). In this embodiment, the metal substrate (102) is of an inverted "V" type structure, the LED chips (103) are distributed on the two outer sides of the metal substrate (102), and the LED chips (103) on each side are connected in series by gold wires. As shown in FIG. 13, the LED chip (103) is connected in series to the electrode leading-out device (105), and the other end of the LED chip (103) is connected in series to the metal substrate to realize electrical connection. The inner side of the metal substrate (102) is further coated with an infrared radiation converting layer (104), the infrared radiation converting layer (104) is made from a mixture of a bonding material and a radiation cooling material, the bonding material may be one or more of silica gel, epoxy resin, plastic, transparent glue, transparent paint and polymer, and the radiation cooling material may be one or more of graphite, carbon black, graphene, carbon nanotube, boron nitride, aluminum oxide, aluminum nitride, silicon nitride, magnesium oxide, heat conducting ceramic powder, and mica powder. Preferably, the radiation cooling material may be a mixture of mica powder and other high heat conductivity materials. It has been proved by experiments that mica powder has excellent infrared radiation performance, which can convert heat into an infrared wave of 2 to 20 μm. The mica powder is mixed with a high heat conductivity material, so that the heat can be more efficiently transmitted to the mica powder, thereby being converted into an infrared wave and radiated.

FIG. 20 to FIG. 23 are comparison diagrams of a junction temperature of different batches of LED lighting bars coated with an infrared radiation converting layer and a chip uncoated with an infrared radiation converting layer provided by the present invention. The junction temperatures of LED filament chips coated with an infrared radiation converting layer and not coated with an infrared radiation converting layer are compared under the same power respectively. As can be seen from the figure, by the heat dissipation system of the present invention, under the same conditions, the working temperature of each LED lighting bar can be reduced by 10 to 12° C. compared with an LED filament lamp not coated with an infrared radiation heat dissipation material. Moreover, as the power is higher, the temperature drops more obviously.

Figure 14:
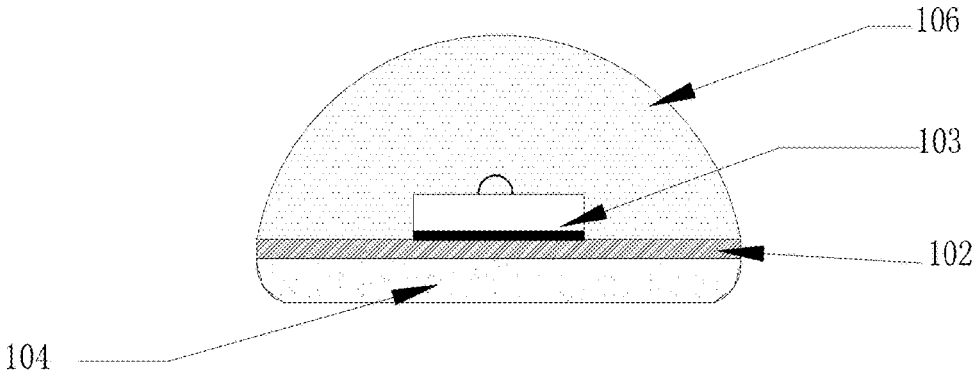
FIG. 14 is a sectional view of an LED lighting bar provided by the present invention.
Figure 15:
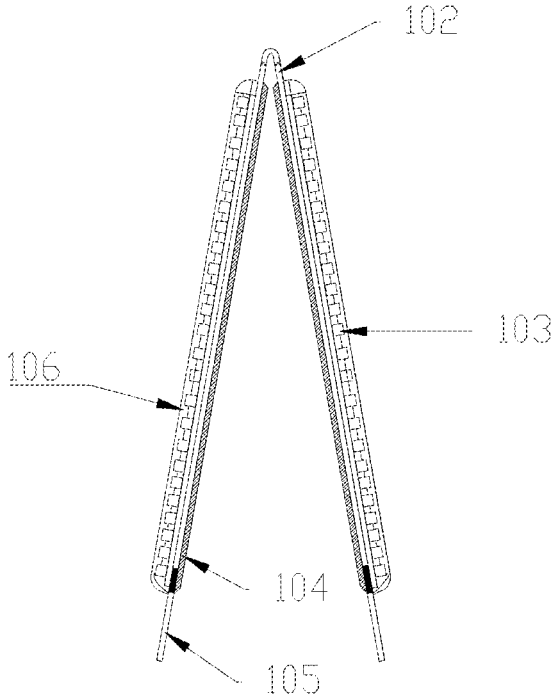
FIG. 15 is a schematic structure diagram of another LED lighting bar provided by the present invention.
Figure 16:
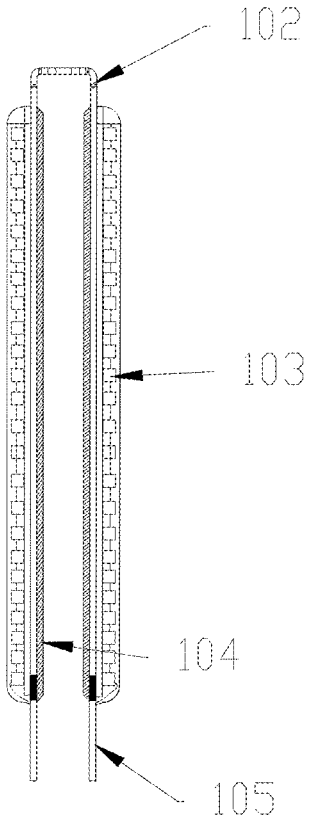
FIG. 16 is a schematic structure diagram of another LED lighting bar provided by the present invention.
Figure 17:
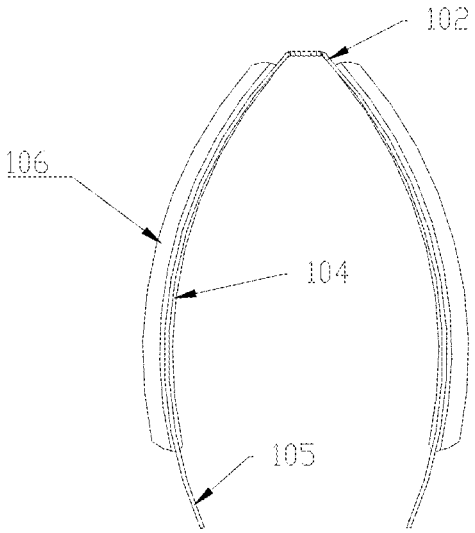
FIG. 17 is a structure diagram of another LED lighting bar provided by the present invention.
Figure 18:
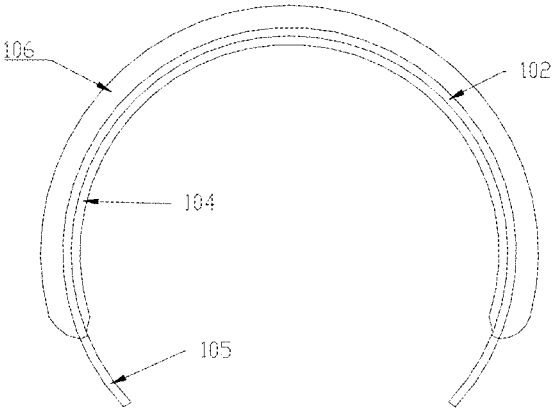
FIG. 18 is a structure diagram of another LED lighting bar provided by the present invention.

In practical applications, the metal substrate (102) has both ends below the middle portion, and is in an inverted V shape ("∧"), an inverted U shape ("∩"), an arc shape, a trapezoid shape or a right-angled U shape ("⊔") or other irregular shapes as a whole. In this embodiment, the metal substrate (102) is a trapezoid shape as a whole. The metal substrate (102) in the embodiment as shown in FIG. 14 is in an inverted V shape ("∧"). The metal substrate (102) in the embodiment as shown in FIG. 16 is in a shape of a right-angled U ("⊔"). The metal substrate (102) in the embodiment as shown in FIG. 17 and FIG. 18 is in a shape of arc. It should be noted that other shapes that are identical or similar to that of the metal substrate listed in the present invention, i.e., the metal substrate (102) which has both ends below the middle portion should fall within the scope of protection of the present invention. The length of the LED lighting bar in the prior art is only about half of that of the LED lighting bar (1) provided by the present invention, and the both ends cannot be directly connected to the driver (6) at the same time. To meet the needs of the applicable voltage, it is required that two LED lighting bars are connected in series at the tops of the pillars of the core base, and then the remaining ends of the two LED bars are connected to the driver, therefore the production process is complex and complicated. There is only one LED lighting bar (1) needed in the present invention to realize the function of the original two LED lighting bars, and there is no complicated operations needed such as soldering and series connection between the LED lighting bars.

In practical applications, as shown in FIG. 11, the LED chips (103) are distributed on both outer sides of the metal substrate (102), and are 2π light-emitting LED chips (103). When there is only one LED lighting bar (1) applied to the LED filament lamp, the LED chips (103) can be continuously arranged on the outer side of the metal substrate (102), as shown in FIG. 18. When the number of the LED lighting bars (1) applied to the LED filament lamp is 2 or more, the middle portion of the metal substrate (102) is connected to the insulating layer (8) and has no LED chips (103) thereon.

In practical applications, the LED chip (103) is one of a blue LED chip, a red LED chip, a green LED chip, a yellow LED chip, a violet LED chip, or any combination thereof.

In practical applications, a surface of the metal substrate (102) with the LED chip (103) is provided with a phosphor layer (106), the phosphor layer (106) comprises a phosphor and a transparent medium, the transparent medium comprises one or more of silica gel, epoxy resin, plastic, transparent glue, transparent paint and polymer. The LED lighting bar of the present invention is 2π light emitting, and only needs to be coated with a phosphor layer on one side to ensure that no blue light is leaked, and the LED filament with a transparent substrate must ensure that the filament is completely coated by the phosphor layer so as not to leak blue light.

The phosphor may be any combination of YAG-series yellow powder, YAG-series yellow green powder, or silicate-series yellow powder, silicate-series yellow green powder, silicate-series orange powder, or nitride-series red powder, nitrogen oxide-series red powder, or YAG-series phosphors, silicate-series phosphors, nitride-series phosphors, and oxynitride-series phosphors.

Preferably, the infrared radiation converting layer (104) is further doped with reflective powder. Further, the reflective powder and the phosphor layer are consistent in color. Preferably, it may be yellow reflective powder or white reflective powder, so that the inner and outer surfaces of the LED lighting bar are kept consistent, and no chromatic aberration is formed on the back of the metal substrate, so that the luminous effect is improved.

The present invention integrates heat dissipation manners such as heat conduction, gas convection heat dissipation and radiation heat dissipation to form a heat dissipation system with an outstanding heat dissipation effect, and comprehensively enhances the heat dissipation performance of the LED lighting bar and the LED filament lamp. The heat of the LED filament lamp mainly comes from an LED chip and a power device on a driver. For heat generated by the LED chip, firstly, the LED lighting bar uses a metal substrate which has excellent conduction heat dissipation performance, the heat conductivity coefficient of metal is at least dozens of times that of glass and the like, and the heat generated by the LED chip can be conducted very quickly; secondly, an infrared radiation converting layer is coated on the inner side of the metal substrate of the LED lighting bar, a silicate-based glass bulb shell with a high infrared transmittance is used, the heat conducted via the metal substrate is converted into an infrared wave of 2 to 20 μm through the infrared radiation converting layer according to the principle of radiation heat dissipation, and then the infrared wave is directly transmitted to an external environment via a silicate-based glass bulb shell. In addition, the bulb shell is filled with a gas of high heat conductivity, and the heat is dissipated by gas convection. For the power device on the driver, the driver is coated with an insulating heat conducting mud and is connected to the lamp cap through the insulating heat conducting mud, and heat generated on the driver is conducted to the metal wall of the lamp cap through the insulating heat conducting mud and is dissipated through the lamp cap. By the heat dissipation system of the present invention, the working temperature of each LED lighting bar can be reduced by 10 to 12° C.

Through the all-round heat dissipation design, the LED filament lamp is greatly reduced in operating temperature compared with the LED filament lamp in the prior art, and the luminous efficiency is further improved as the temperature is lowered. A common type LED filament lamp A60 can only achieve the upper limit of 806 lm in the past, and the same type of LED filament lamp provided by the present invention can be increased to 1520 lm.

The LED lighting bar of the present invention is 2π light emitting, and only needs to be coated with a phosphor layer on one side to ensure that no blue light is leaked, and the LED filament with a transparent substrate must ensure that the filament is completely coated by the phosphor layer so as not to leak blue light.

The disclosure of the present invention is simple in manufacturing process and easy to mechanize the assembly of the filament. The LED lighting bar provided by the present invention uses an inverted V shape ("∧"), an inverted U shape ("∩"), an arc shape, a trapezoid shape or a right-angled U shape ("| |") structure, one LED lighting bar is equivalent to two lighting bars of the prior art, and both ends of the LED lighting bar can be directly fixed on the same plane of a core base, which is easy to mechanize the assembly of the filament. The core base eliminates a narrow bracket or pillar, which reduces the soldering points, thereby simplifying the production process and improving the production efficiency.

The disclosure of the present invention is low in cost. On the one hand, one LED lighting bar provided by the present invention is equivalent to the existing two lighting bars. On the other hand, a metal substrate is used instead of an expensive sapphire or diamond substrate, so that the production cost is reduced.

The disclosure of the present invention has excellent visual effect. When an ordinary 2π light-emitting LED filament is not working, there is obvious chromatic aberration on the back of the filament, which affects the visual effect. The infrared radiation converting layer is coated on the back side, and furthermore, reflective powder is doped, so that the color of the inner and outer materials of the LED lighting bar is kept consistent, and no chromatic aberration is formed on the back of the metal substrate, so that the visual effect is improved.

The disclosure of the present invention is energy-saving and environment-friendly. The radiation cooling material described in the present invention preferably uses a mixture of mica powder and a high heat conductivity material, and the heat can be converted into an infrared wave of 2 to 20 μm and radiated into the surrounding environment without causing pollution to the environment.

It is to be understood that the application of the present invention is not limited to the above examples, and a person of ordinary skill in the art can make modifications or changes in accordance with the above description, all of which are within the scope of protection of the appended claims of the present invention.

The invention claimed is:

1. An LED filament lamp using infrared radiation heat dissipation, comprising:

a bulb shell with an infrared transmittance larger than 0.8;

a core base with an exhaust pipe;

a driver;

a lamp cap;

at least one LED lighting bar with 2π light-emitting LED chip;

the bulb shell and the core base are in vacuum sealing to form a vacuum sealed cavity and the vacuum sealed cavity is filled with high heat conductivity gas;

the LED lighting bar is located in the vacuum sealed cavity, one side of the LED lighting bar being provided with a light-emitting layer of the LED chip, and the other side being provided with an infrared radiation converting layer;

both ends of the LED lighting bar are fixed to the core base through a metal wire respectively, and are connected to the driver which is fixed below the core base;

and the driver and the lamp cap are connected in series through an outer electrode leading-out wire.

2. The LED filament lamp using infrared radiation heat dissipation according to claim 1, wherein the infrared radiation converting layer comprises a bonding material and a radiation cooling material, the bonding material being selected from one or more of silica gel, epoxy resin, plastic, transparent glue, transparent paint and polymer; and the radiation cooling material being made from a mixture of a radiation material with an infrared emissivity larger than 0.8 and a high heat conductivity material.

3. The LED filament lamp using infrared radiation heat dissipation according to claim 2, wherein the radiation material with an infrared emissivity larger than 0.8 is selected from any one of mica powder, aluminium oxide, mullite, silicon oxide, and silicon carbide.

4. The LED filament lamp using infrared radiation heat dissipation according to claim 2, wherein the high heat conductivity material is selected from one or more of graphite, carbon black, graphene, carbon nanotube, boron nitride, aluminum oxide, aluminum nitride, silicon nitride, magnesium oxide, and heat conducting ceramic powder.

5. The LED filament lamp using infrared radiation heat dissipation according to claim 1, wherein the LED lighting bar is in an inverted V shape, an inverted U shape, an arc shape, a trapezoid shape or a right-angled U shape as a whole.

6. The LED filament lamp using infrared radiation heat dissipation according to claim 5, wherein there are at least two LED lighting bars, connected in parallel with each other, and the middle parts of the lighting bars being connected by an insulating layer and in crossed arrangement.

7. The LED filament lamp using infrared radiation heat dissipation according to claim 6, wherein the middle part of the LED lighting bar is provided with a through hole, and the insulating layer is provided with, at the corresponding position, a lug boss matched with the through hole.

8. The LED filament lamp using infrared radiation heat dissipation according to claim 4, wherein the driver is coated with an insulating heat conducting mud which is connected to the lamp cap, and the insulating heat conducting mud is made from a mixture of the bonding material and the high heat conductivity material.

9. The LED filament lamp using infrared radiation heat dissipation according to claim 1, wherein the bulb shell with an infrared transmittance larger than 0.8 is a silicate-based glass bulb shell.

10. The LED filament lamp using infrared radiation heat dissipation according to claim 9, wherein the bulb shell uses an A-type bulb shell, a G-type bulb shell, a PAR-type bulb shell, a T-type bulb shell, a candle-type bulb shell, a P-type bulb shell, a PS-type bulb shell, a BR-type bulb shell, an ER-type bulb shell or a BRL-type bulb shell; and the lamp cap uses E12 type, E14 type, E27 type, E26 type, E40 type, GU type, BX type, BA type, EP type, EX type, GY type, GX type, GR type, GZ type or G type.

11. An LED lighting bar using infrared radiation heat dissipation, comprising: a metal substrate, at least one string of 2π light-emitting LED chips located on the metal substrate and connected in series in the same PN junction direction; the back of the metal substrate is provided with an infrared radiation converting layer, which comprises a bonding material and a radiation cooling material, the bonding material is selected from one or more of silica gel, epoxy resin, plastic, transparent glue, transparent paint and polymer, and the radiation cooling material is made from a mixture of a radiation material with an infrared emissivity larger than 0.8 and a high heat conductivity material.

12. The LED lighting bar using infrared radiation heat dissipation according to claim 11, wherein the radiation material with an infrared emissivity larger than 0.8 comprises any one of mica powder, aluminium oxide, mullite, silicon oxide, and silicon carbide, and the high heat conductivity material being selected from one or more of graphite, carbon black, graphene, carbon nanotube, boron nitride, aluminum oxide, aluminum nitride, silicon nitride, magnesium oxide, and heat conducting ceramic powder.

13. The LED lighting bar using infrared radiation heat dissipation according to claim 11, wherein the metal substrate is in an inverted V shape, an inverted U shape, an arc shape, a trapezoid shape or a right-angled U shape as a whole.

14. The LED lighting bar using infrared radiation heat dissipation according to claim 11, wherein the LED chip is one of a blue LED chip, a red LED chip, a green LED chip, a yellow LED chip, a violet LED chip, or any combination thereof.

15. The LED lighting bar using infrared radiation heat dissipation according to claim 11, wherein a surface of the metal substrate with the LED chip is provided with a phosphor layer, the phosphor layer comprising a phosphor and a transparent medium, the transparent medium comprising one or more of silica gel, epoxy resin, plastic, transparent glue, transparent paint and polymer.

16. The LED lighting bar using infrared radiation heat dissipation according to claim 15, wherein the phosphor is any combination of YAG-series yellow powder, YAG-series yellow green powder, or silicate-series yellow powder, silicate-series yellow green powder, silicate-series orange powder, or nitride-series red powder, nitrogen oxide-series red powder, or YAG-series phosphors, silicate-series phosphors, nitride-series phosphors, and nitrogen oxide-series phosphors.

17. The LED lighting bar using infrared radiation heat dissipation according to claim 16, wherein the infrared radiation converting layer is further doped with reflective powder, and the reflective powder has a color similar to that of the phosphor layer.

* * * * *